US008112271B2

(12) United States Patent
Morii

(10) Patent No.: US 8,112,271 B2
(45) Date of Patent: Feb. 7, 2012

(54) AUDIO ENCODING DEVICE AND AUDIO ENCODING METHOD

(75) Inventor: Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 465 days.

(21) Appl. No.: 12/376,640

(22) PCT Filed: Aug. 7, 2007

(86) PCT No.: PCT/JP2007/065452

§ 371 (c)(1),
(2), (4) Date: Feb. 6, 2009

(87) PCT Pub. No.: WO2008/018464

PCT Pub. Date: Feb. 14, 2008

(65) Prior Publication Data

US 2010/0179807 A1 Jul. 15, 2010

(30) Foreign Application Priority Data

Aug. 8, 2006 (JP) ..... 2006-216148

(51) Int. Cl.
*G10L 19/12* (2006.01)

(52) U.S. Cl. ..... 704/223; 704/221; 704/219

(58) Field of Classification Search ..... 704/223, 704/221, 222, 219, 220, 230, 500
See application file for complete search history.

(56) References Cited

U.S. PATENT DOCUMENTS 5,173,941 A 12/1992 Yip et al.
5,179,594 A 1/1993 Yip et al.
5,187,745 A 2/1993 Yip et al.
5,199,076 A 3/1993 Taniguchi et al.
5,265,190 A 11/1993 Yip et al.
5,485,581 A 1/1996 Miyano et al.
5,664,055 A 9/1997 Kroon
6,453,288 B1 9/2002 Yasunaga et al.

(Continued)

FOREIGN PATENT DOCUMENTS

JP 4-270400 A 9/1992

(Continued)

OTHER PUBLICATIONS

Salami et al., "8 KBIT/S ACELP Coding of Speech With 10 MS Speech-Frame: A Candidate for CCITT Standardization," IEEE Proc. ICASSP94 vol. ii, pp. II97-II100, XP 010133917.

(Continued)

*Primary Examiner* — Huyen X. Vo

(74) *Attorney, Agent, or Firm* — Greenblum & Bernstein, P.L.C.

(57) ABSTRACT

Provided is an audio encoding device capable of improving performance of an adaptive codebook and improving quality of a decoded audio. In this audio encoding device, an adaptive codebook cuts out a vector specified by a comparator from adaptive code vectors stored in an internal buffer and outputs it to a filter and a switch. The filter performs a predetermined filtering process on the adaptive sound source signal and outputs the obtained adaptive code vector to the switch. According to an instruction from the comparator, the switch outputs the adaptive code vector directly output from the adaptive codebook to a adjuster when the adaptive codebook is searched and outputs the adaptive code vector output from the filter after being subjected to the filtering process to the gain adjuster when a fixed sound source is searched after the adaptive sound source search.

9 Claims, 5 Drawing Sheets

U.S. PATENT DOCUMENTS

| | | | | |
|---|---|---|---|---|
| 6,947,889 | B2 | 9/2005 | Yasunaga et al. | |
| 7,110,943 | B1 | 9/2006 | Morii et al. | |
| 7,203,641 | B2 * | 4/2007 | Tasaki | 704/223 |
| 7,289,953 | B2 | 10/2007 | Yasunaga et al. | |
| 7,383,176 | B2 | 6/2008 | Yasunaga et al. | |
| 2003/0004710 | A1 | 1/2003 | Gao | |

FOREIGN PATENT DOCUMENTS

| | | | |
|---|---|---|---|
| JP | 5-061499 | A | 3/1993 |
| JP | 6-138896 | A | 5/1994 |
| JP | 9-120299 | A | 5/1997 |
| JP | 9-204198 | A | 8/1997 |
| JP | 9-319399 | A | 12/1997 |
| JP | 2003-029798 | A | 1/2003 |

OTHER PUBLICATIONS

Kroon et al., "Strategies for Improving the performance of CELP Coders at Low Rates ( Speech analysis )", 19880411; 19880411-19880414, Apr. 11, 1988, pp. 151-154, XP 010073075.

Salami et al., "8 KBITS/S ACELP Coding of Speech With 10 MS Speech-Frame: A Candidate for CCITT Standardization," IEEE Proc. ICASSP94, pp. II97-II100.

* cited by examiner

AUDIO ENCODING DEVICE AND AUDIO ENCODING METHOD

TECHNICAL FIELD

The present invention relates to a speech coding apparatus and speech coding method using adaptive codebooks.

BACKGROUND ART

In mobile communication, compression coding for digital information of speech and images is essential for efficient use of transmission band. Here, expectations for speech codec (coding and decoding) techniques widely used in mobile telephones are high, and further sound quality improvement is in demand in addition to conventional high-efficiency coding of high compression performance. Further, speech communication is a basic function of mobile telephones and therefore is essential to be standardized, and, given the tremendous value of intellectual property rights it entails, is actively researched and developed by companies all over the world.

The basic scheme "CELP (Code Excited Linear Prediction)," which models the vocal system of speech established about twenty yeas ago and which adopts vector quantization skillfully, has improved decoded speech quality significantly. Further, the emergence of techniques using fixed excitations comprised of a small number of pulses like with an algebraic codebook (e.g., disclosed in Non-Patent Document 1) has marked further advancement in speech coding performance.

However, in CELP, as for spectrum envelope information, high efficiency coding methods such as line spectrum pair ("LSP") parameters and prediction VQ (Vector Quantization) are developed, and, as for a fixed codebook, high efficiency coding methods are developed such as the above-noted algebraic codebook. However, few studies have been made to improve performance of only an adaptive codebook.

Therefore, although sound improvement of CELP has peaked up till now, to solve this problem, Patent Document 1 discloses a technique of limiting a frequency band of adaptive codebook code vectors (hereinafter "adaptive excitations") by the filter adapted to an input acoustic signal and using the code vectors after the frequency band limitation to generate synthesis signals.

Patent Document 1: Japanese Patent Application Laid-Open No. 2003-29798

Non-Patent Document 1: Salami, Laflamme, Adoul, "8 kbit/s ACELP Coding of Speech with 10 ms Speech-Frame: a Candidate for CCITT Standardization", IEEE Proc. ICASSP94, pp. II-97n

DISCLOSURE OF INVENTION

Problem to be Solved by the Invention

Patent Document 1 discloses a technique of adaptively controlling a band such that the band matches the frequency band of components to be expressed by modeling, by limiting the frequency band using a filter adapted to an input acoustic signal. However, according to the techniques disclosed in Patent Document 1, an occurrence of distortion by unnecessary components is only suppressed, and a synthesis signal generated based on an adaptive excitation is made by applying an inverse filter of a perceptual weighting synthesis filter to an input speech signal. That is, an adaptive excitation is not made similar to an ideal excitation (i.e., ideal excitation with minimized distortion) at high accuracy.

For example, if adaptive codebooks are improved by enhancing an adaptive codebook search method from the standpoint of distortion minimization, the effect of reducing distortion statistically should be provided. However, Patent Document 1 does not disclose this point.

In view of the above, it is therefore an object of the present invention to provide a speech coding apparatus and speech coding method for improving adaptive codebook performance and improving decoded speech quality.

Means for Solving the Problem

The coding apparatus of the present invention employs a configuration having: an excitation search section that performs an adaptive excitation search and fixed excitation search; an adaptive codebook that stores an adaptive excitation and clips part of the adaptive excitation; a filtering section that performs predetermined filtering processing on the adaptive excitation clipped from the adaptive codebook; and a fixed codebook that stores a plurality of fixed excitations and extracts a fixed excitation indicated from the excitation search section, and in which the excitation search section performs a search using the adaptive excitation clipped from the adaptive codebook upon the adaptive excitation search, and performs a search using the adaptive excitation after the filtering processing upon the fixed excitation search

Advantageous Effect of the Invention

According to the present invention, when an adaptive excitation signal is acquired using a lag found in separate speech coding processing and such, it is possible to compensate for typical deterioration of the adaptive excitation signal caused by the mismatch of the lag. By this means, it is possible to improve adaptive codebook performance and improve decoded speech quality.

BEST MODE FOR CARRYING OUT THE INVENTION

Embodiments of the present invention will be explained below in detail with reference to the accompanying drawings. Further, a configuration example will be explained with the specification where CELP is used as a speech coding scheme.

Embodiment 1

Figure 1:
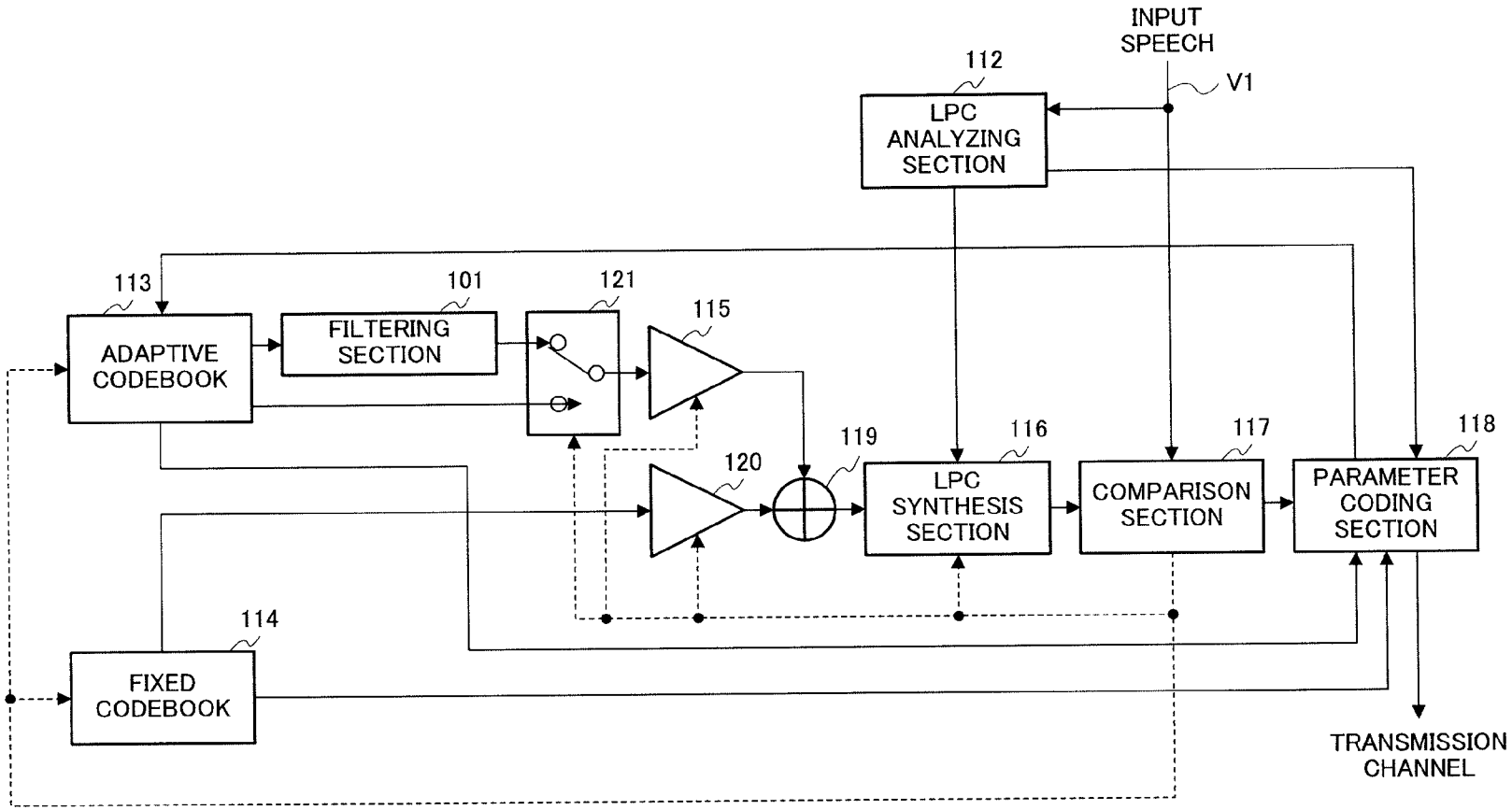
FIG. 1 is a block diagram showing the main components of a speech coding apparatus according to Embodiment 1 of the present invention.

FIG. 1 is a block diagram showing the main components of the speech coding apparatus according to Embodiment 1 of the present invention. The solid lines show inputs and outputs of a speech signal and various parameters. Further, the dotted lines show inputs and outputs of a control signal.

The speech coding apparatus according to the present embodiment is mainly configured with filtering section 101, LPC analyzing section 112, adaptive codebook 113, fixed codebook 114, gain adjusting section 115, gain adjusting section 120, adder 119, LPC synthesis section 116, comparison section 117, parameter coding section 118 and switching section 121.

The sections of the speech coding apparatus according to the present embodiment will perform the following operations.

LPC analyzing section 112 acquires an LPC coefficient by performing an autocorrelation analysis and LPC analysis of inputted speech signal V1, and acquires an LPC code by encoding the acquired LPC coefficient. This coding is performed by converting the inputted speech signal into parameters that are likely to be quantized such as a PARCOR coefficient, LSP and ISP, and then quantizing the acquired parameters by prediction processing and vector quantization using past decoded parameters. Further, LPC analyzing section 112 decodes the acquired LPC code and acquires the decoded LPC coefficient. Further, LPC analyzing section 112 outputs the LPC code to parameter coding section 118 and outputs the decoded LPC coefficient to LPC synthesis section 116.

Adaptive codebook 113 clips (i.e., extracts) an adaptive code vector designated by comparison section 117 amongst the adaptive code vectors (or adaptive excitations) stored in the inner buffer, and outputs the clipped adaptive code vector to filtering section 101 and switching section 121. Further, adaptive codebook 113 outputs the index (i.e., excitation code) of the excitation sample to parameter coding section 118.

Filtering section 101 performs predetermined filtering processing on the adaptive excitation signal outputted from adaptive codebook 113 and outputs the acquired adaptive code vector to switching section 121. Further, this filtering processing will be described later in detail.

Switching section 121 selects an input to gain adjusting section 115 according to the designation from comparison section 117. To be more specific, when a search (i.e., adaptive excitation search) is performed in adaptive codebook 113, switching section 121 selects the adaptive code vector outputted from adaptive codebook 113, and, when a fixed excitation search is performed after an adaptive excitation search, switching section 121 selects the adaptive code vector subjected to filtering processing and outputted from filtering section 101.

Fixed codebook 114 extracts a fixed code vector designated from comparison section 117 amongst the fixed code vectors (or fixed excitations) stored in the inner buffer, and outputs the extracted fixed code vector to gain adjusting section 120. Further, fixed codebook 114 outputs the index (i.e., excitation code) of the excitation sample to parameter coding section 118.

Gain adjusting section 115 performs a gain adjustment by multiplying the adaptive code vector subjected to filtering processing and selected from switching section 121 or the adaptive code vector outputted direct from adaptive codebook 113, by a gain designated from comparison section 117, and outputs the adaptive code vector after the gain adjustment to adder 119.

Gain adjusting section 120 performs a gain adjustment by multiplying the fixed code vector outputted from fixed codebook 114 by a gain designated from comparison section 117, and outputs the fixed code vector after the gain adjustment to adder 119.

Adder 119 acquires an excitation vector by adding the code vectors (i.e., excitation vectors) outputted from gain adjusting section 115 and gain adjusting section 120, and outputs the acquired excitation vector to LPC synthesis section 116.

LPC synthesis section 116 synthesizes the excitation vector outputted from adder 119 by an all-pole filter using LPC parameters, and outputs the acquired synthesis signal to comparison section 117. However, in actual, coding, two synthesis signals are acquired by filtering two excitation vectors (i.e., adaptive excitation and fixed excitation) before gain adjustment, using the decoded LPC coefficient acquired from LPC analyzing section 112. This processing is performed for more efficient excitation coding. Further, LPC synthesis upon the excitation search in LPC synthesis section 116 uses a perceptual weighting filter using a linear prediction coefficient, high band enhancement filter, long term prediction coefficient (which is acquired by performing a long term prediction analysis of input speech), etc.

By calculating the distance between the synthesis signal acquired in LPC synthesis section 116 and the input speech signal V1 and controlling the output vectors from two codebooks (i.e., adaptive codebook 113 and fixed codebook 114) and the gain multiplied in gain adjusting section 115, comparison section 117 searches for the combination of two excitation codes of the closest distance. However, in actual coding, comparison section 117 analyzes the relationships between two synthesis signals and input speech signal acquired in LPC synthesis section 116, calculates the combination of optimal values (i.e., optimal gains) of the two synthesis signals, adds the synthesis signals after gain adjustment using the optimal gains in gain adjusting section 115 to acquire a sum synthesis signal, and calculates the distance between the sum synthesis signal and input speech signal. Further, comparison section 117 calculates the distance between the input speech signal and many synthesis signals acquired by operating gain adjusting section 115 and LPC synthesis section 116 for all excitation samples in adaptive codebook 113 and fixed codebook 114, and compares the calculated distances to find the indexes of excitation samples of the minimum distance. Further, comparison section 117 outputs two finally acquired codebook indexes (i.e., codes), two synthesis signals associated with these indexes, and the input speech signal to parameter coding section 118.

Parameter coding section 118 acquires a gain code by encoding the gain using the correlation between the two synthesis signals and input speech signal. Further, parameter coding section 118 outputs all of the gain code, LPC code, and indexes (i.e., excitation codes) of the excitation samples of two codebooks 113 and 114, to the transmission channel. Further, parameter coding section 118 decodes an excitation signal using the gain code and two excitation samples associated with the excitation codes (here, the adaptive excitation is changed in filtering section 101), and stores the decoded signal in adaptive codebook 113. In this case, old excitation samples are discarded. That is, decoded excitation data of adaptive codebook 113 is shifted backward in memory, old data outputted from the memory is discarded, and excitation signals made by decoding are stored in the positions that become empty. This processing is referred to as state updating of an adaptive codebook (this processing is realized by the line starting from parameter coding section 118 to adaptive codebook 113 in FIG. 1).

Further, according to the present embodiment, in an excitation search, optimizing the adaptive codebook and the fixed codebook at the same time would require an enormous amount of calculations and consequently is virtually impossible, and therefore an open loop search of determining the code of each codebook one by one is performed. That is, an adaptive codebook code is acquired by comparing a synthesis signal comprised of only adaptive excitations to an input speech signal, and, next, a fixed codebook code is determined by fixing the adaptive codebook excitation, controlling excitation samples from the fixed codebook, acquiring many sum synthesis signals by combinations of optimal gains, and comparing the acquired sum synthesis signals and input speech. With the above-noted steps, it is possible to realize a search by an existing miniature processor (such as DSP).

Further, an excitation search in adaptive codebook 113 and fixed codebook 114 is performed in subframes further dividing a frame as a general processing unit period of coding.

Next, conversion processing of an adaptive excitation signal mainly using filtering section 101 will be explained in detail using FIG. 2 and FIG. 3.

Figure 2:
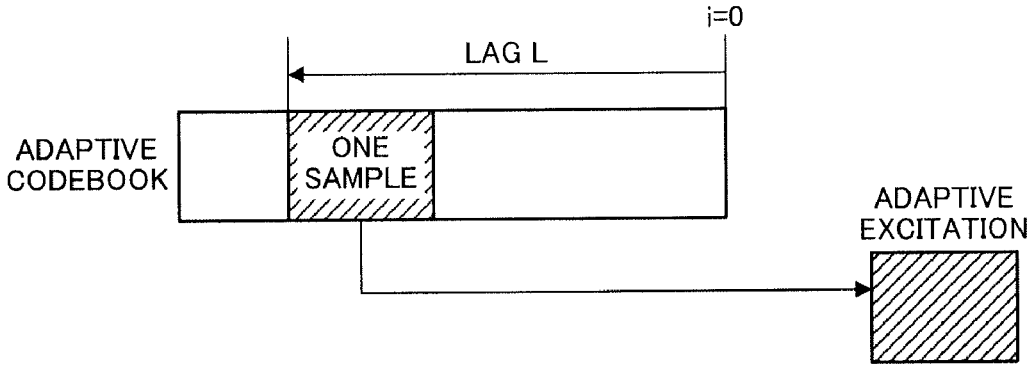
FIG. 2 is a schematic view of clipping processing of an adaptive excitation signal.

FIG. 2 is a schematic view of clipping processing in adaptive codebook 113. The clipped adaptive excitation signal is inputted to filtering section 101. Following equation 1 shows the clipping processing of an adaptive excitation signal.

[1]

$$e_i = e_{i-L} \quad \text{(Equation 1)}$$

where $e_i$: adaptive excitation clipped from adaptive codebook i: sample number (i<0)

L: lag

Figure 3:
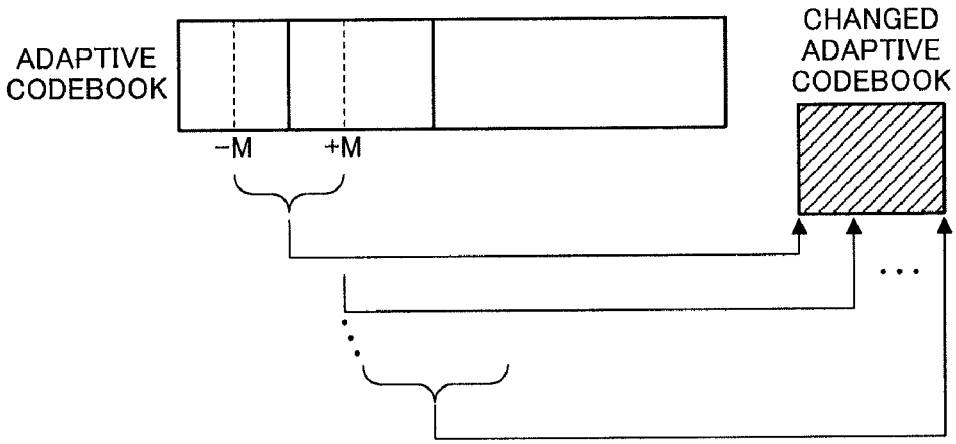
FIG. 3 is a schematic view of filtering processing of an adaptive excitation signal.

FIG. 3 is a schematic view of filtering processing of an adaptive excitation signal. Filtering section 101 performs a linear filtering of adaptive excitation signals clipped from the adaptive codebook according to an inputted lag. According to the present embodiment, MA (Moving Average) type multi-tap filtering processing is performed. For the filter coefficient, a fixed coefficient found in the design phase is used. Further, in this filtering, the above-noted adaptive excitation signal and adaptive codebook 113 are used. First, for every sample of the adaptive excitation signal, a product sum is found by multiplying, by a filter coefficient, the values of samples in a range of M samples before and after the reference of the sample L samples before the adaptive excitation signal sample in adaptive codebook 113, and the resulting value is added to the value of the sample and provides a new value. This gives a "converted adaptive excitation signal."

Here, if lag L is short, the range between −M and +M may go beyond the range of the adaptive excitation stored in adaptive codebook 113. In this case, if +M part goes beyond the range of the adaptive excitation, by deciding that the clipped adaptive excitation (which is targeted of the filtering processing according to the present embodiment) is connected to the end of an adaptive excitation stored in adaptive codebook 113, it is possible to perform the above-noted filtering processing with no difficulty. Further, to prevent the −M part from going beyond the range, an adaptive excitation of a sufficient length is stored in adaptive codebook 113.

Further, the speech coding apparatus according to the present embodiment encodes an input speech signal using the adaptive excitation signal outputted direct from adaptive codebook 113 and the above-noted changed excitation signal. This conversion processing can be expressed by following equation 2. The second term of the right side in following equation 2 shows filtering processing.

(Equation 2)

$$e'_i = e_i + \sum_{j=-M}^{M} f_j e_{i-L+j} \quad [2]$$

where $e'_i$: changed adaptive excitation $f_j$: filter coefficient

M: upper limit of the number of taps of filter

The fixed coefficient used as the filter coefficient of the MA type multi-tap filter is designed in the design phase such that the result of performing the same filtering of clipped adaptive excitations is the closest to an ideal excitation. With reference to many speech data samples for learning, this fixed coefficient is calculated by solving a linear equation acquired by partially differentiating the filter coefficient in the cost function about the difference between the changed adaptive excitation and the ideal excitation. Cost function E is shown by following equation 3.

(Equation 3)

$$E = \sum_t \sum_i \left\{ r_i^t - \left( e_i^t + \sum_{j=-M}^{M} f_j e_{i-L+j}^t \right) \right\}^2 \quad [3]$$

where:

i: sample number t: frame number

Further, by calculating a filter coefficient by the above statistical processing based on sufficient learning data and performing filtering processing using the calculated filter coefficient, it is obvious from the above-noted steps of coefficient calculation that coding distortion decreases on average.

Further, taking into account that speech is encoded, and further taking into account the basic cycle of human's voiced sound, the range of lag L is designed in the design phase such that the greatest coding performance can be acquired with a limited number of bits.

The upper limit value, M, of the number of taps of a filter (i.e., the range of the number of taps of a filter is between −M and +M), is preferably set equal to or less than the minimum value of the fundamental cycle. The reason is that samples provided in this cycle would naturally have high correlation with the waveform one cycle later, and, consequently, filter coefficients are not likely to be calculated efficiently by learning. Further, when the upper limit value is M, the order of the filter is 2M+1.

Next, in the speech coding method according to the present embodiment, in particular, processing steps of an adaptive excitation search, fixed excitation search and gain quantization will be explained using the flowchart shown in FIG. 4.

Finding all codes in a closed loop requires an enormous amount of calculations, and, consequently, with the speech coding method according to the present embodiment, codes are determined in order by an adaptive codebook search, fixed codebook search and gain quantization. First, under control of comparison section 117, a search is performed in adaptive codebook 113 (ST 1010) to search for the adaptive excitation signal to minimize the coding distortion of a synthesis signal outputted from LPC synthesis section 116. Next, an adaptive excitation signal conversion, which will be described later, is performed by filtering processing in filtering section 101 (ST 1020), and, using this converted adaptive excitation signal, under control of comparison section 117, a search is performed in fixed codebook 114 (ST 1030) to search for the fixed excitation signal to minimize the coding distortion of a synthesis signal outputted from LPC synthesis section 116. Further, after an optimal adaptive excitation and fixed excitation are found, under control of comparison section 117, gain quantization is performed (ST 1040).

Figure 4:
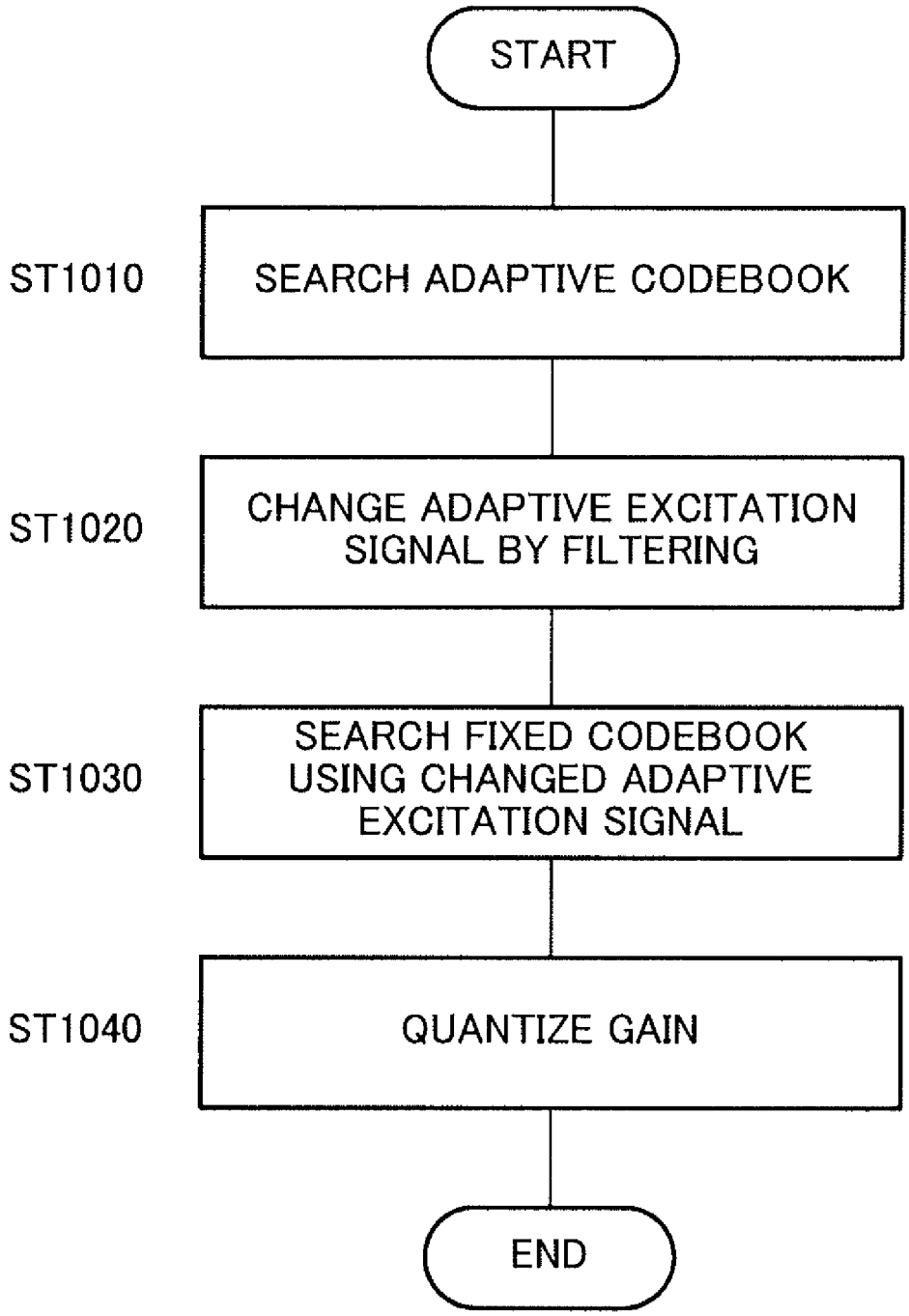
FIG. 4 is a flowchart showing processing steps of an adaptive excitation search, fixed excitation search and gain quantization according to Embodiment 1.

That is, as shown in FIG. 4, with the speech coding method according to the present embodiment, filtering is performed for an acquired adaptive excitation signal as a result of the search in the adaptive codebook. Switching section 121 shown in FIG. 1 is provided to realize this processing. Further, although switching section 121 having two input terminals and one output terminal is provided before gain adjusting section 115 with the present embodiment, it is alternatively possible to employ a configuration having a switching section having one input terminal and two output terminals after adaptive codebook 113 and selecting based on the command from comparison section 117 whether to input the output to gain adjusting section 115 via filtering section 101 or directly input the output to gain adjusting section 115.

As described above, according to the present embodiment, after an adaptive codebook search is finished and a decoded adaptive excitation is acquired, the adaptive excitation is changed by using the adaptive codebook as the initial state of a filter and performing filtering based on the lag as the reference position. That is, once an adaptive excitation signal is found by an adaptive codebook search, by making this adaptive excitation signal as the initial state of a filter and furthermore performing filtering processing, the adaptive excitation found by the adaptive excitation search is applied changes reflecting the lag (i.e., harmonic structure of speech signal). By this means, the adaptive excitation is improved, so that it is statistically possible to acquire an adaptive excitation close to an ideal excitation and acquire a synthesis signal of higher quality with little coding distortion. That is, it is possible to improve decoded speech quality.

Further, the concept of the conversion processing of an adaptive excitation signal according to the present embodiment is directed to providing, by means of a filter requiring a little amount of calculations and little memory capacity, two advantages of making it possible to make the pitch structure of an adaptive excitation signal more distinct through filtering based on the lag and making it possible to compensate for typical deterioration of excitation signals stored in an adaptive codebook by calculating a filter coefficient by statistical learning to approach to an ideal excitation. Although there are acoustic codec band enhancement techniques (such as SBR, which is spectrum band replication, in MPEG4) adopting the similar concept to the present invention, the present invention provides advantages of requiring little resources by implementing the present invention in the time domain and acquiring higher quality speech by realizing the present invention in the scheme of conventional high-efficiency coding method, CELP.

Embodiment 2

Figure 5:
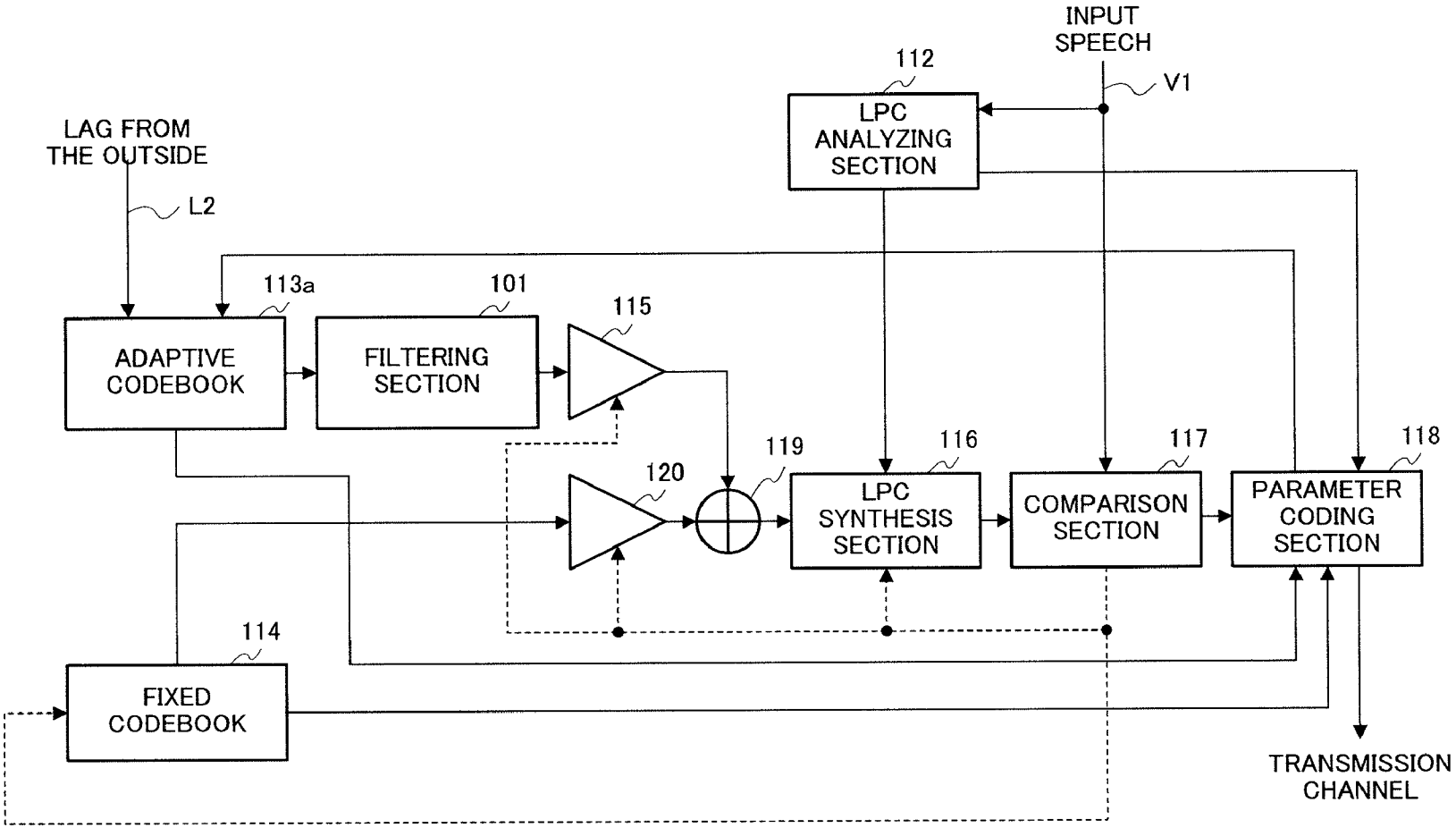
FIG. 5 is a block diagram showing the main components of a speech coding apparatus according to Embodiment 2 of the present invention.

FIG. 5 is a block diagram showing the main components of the speech coding apparatus according to Embodiment 2 of the present invention. Further, this speech coding apparatus has a similar basic configuration as the speech coding apparatus shown in Embodiment 1, and therefore the same components will be assigned the same reference numerals and explanations will be omitted. Further, the components having the same basic operation but having detailed differences will be assigned codes combining the same reference numerals and lower-case letters of alphabets for distinction, and will be explained adequately.

The present embodiment is different from Embodiment 1 in that lag L2 is inputted from the outside the speech coding apparatus according to the present embodiment. This configuration is seen in scalable codecs (i.e., multilayer codecs) which are especially recently standardized in ITU-T and MPEG. In the example shown here, when information encoded in a lower layer is used in a higher layer, although a case is possible where the sampling rate in a lower layer can be lower than in a higher layer, it is possible to use the lag of the adaptive codebook if the basic scheme is CELP. A case will be described with Embodiment 2 where a lag is used as is (in this case, this layer can use an adaptive codebook with zero bits).

In the speech coding apparatus according to the present embodiment, an excitation code (lag) of adaptive codebook 113 is provided from the outside. This is one example, and cases are equally possible where a lag acquired from a speech coding apparatus different from the speech coding apparatus according to the present embodiment is received and where a lag acquired from a pitch analyzer (included in, for example, a pitch enhancer to allow speech to be heard better) is used. That is, a case is possible where the same speech signal is inputted and subjected to analysis processing or coding processing for other uses, and, as a result, the acquired lag is directly used in separate speech coding processing. Further, similar to scalable codecs (such as hierarchical coding and G.729 EV in ITU-T standard), when coding is hierarchically performed, it is possible to adopt the configuration according to the present embodiment in a case where the lag in a lower layer is received in a higher layer.

Figure 6:
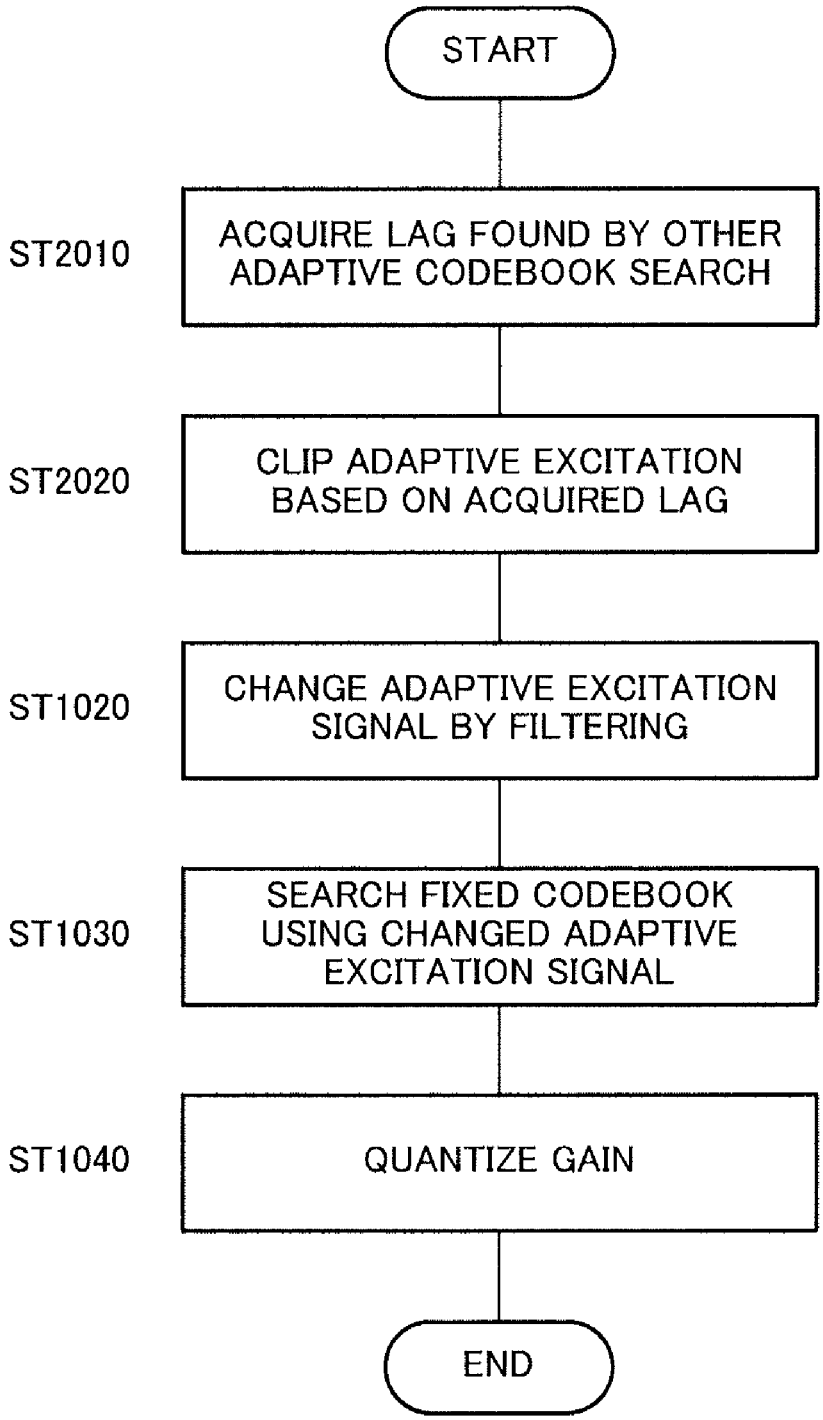
FIG. 6 is a flowchart showing the processing steps of an adaptive excitation search, fixed excitation search and gain quantization according to Embodiment 2.

FIG. 6 is a flowchart showing the processing steps of an adaptive excitation search, fixed excitation search and gain quantization according to the present embodiment.

The speech coding apparatus according to the present embodiment acquires lag L2 found by separate adaptive codebook search in above-noted separate speech coding apparatus and pitch analyzer (ST 2010), and clips an adaptive excitation signal in adaptive codebook 113*a* based on the lag (ST 2020), and filtering section 101 changes the clipped adaptive excitation signal by the above-noted filtering processing (ST 1020). The processing steps after ST 1020 are the same as the steps shown in FIG. 4 of Embodiment 1.

As described above, according to the present embodiment, when an adaptive excitation signal is acquired using a lag found in separate speech coding processing and such, it is possible to compensate for typical deterioration of the adaptive excitation signal caused by the mismatch of the lag. By this means, it is possible to improve an adaptive excitation and improve decoded speech quality.

In particular, as shown in the present embodiment, the present invention produces higher advantages when a lag is provided from the outside. The reason is that, although a case is readily anticipated where a lag provided from the outside does not match with a lag found inside by search, in this case, it is possible to reflect the statistical characteristics of the difference to the filter coefficient by learning. Further, the adaptive codebook is updated by an adaptive excitation signal changed by filtering and fixed excitation signal found by the fixed codebook such that adaptive codebook performance is further improved, so that it is possible to transmit higher quality speech.

Embodiments of the present invention have been explained above.

Further, the speech coding apparatus and speech coding method according to the present embodiment are not limited to the above-described embodiments and can be implemented with various changes.

For example, although a case has been described with Embodiments 1 and 2 where an adaptive excitation signal is changed by filtering using the MA type filter, as a method of producing the same effect with a similar amount of calculations, a method of storing fixed waveforms every lag L and acquiring the fixed waveforms by given lag L to add the fixed waveforms to an adaptive excitation signal is also possible. This adding processing will be shown by following equation 4.

[4]

$$e'_i = e_i + g \cdot C_i^L \quad \text{(Equation 4)}$$

where:

$e'_i$: changed adaptive excitation g: adjusting gain $C_i^L$: fixed waveforms for addition In the above processing, the fixed waveforms for addition, which are stored in ROM (Read Only Memory), are normalized, and, consequently, to adjust the gain to the adaptive excitation signal, the gain shown in following equation 5 is multiplied.

(Equation 5)

$$g = \sqrt{\left(\sum_i^l e_i \cdot e_i\right) \Big/ l} \quad [5]$$

The fixed waveforms for addition are found and stored in advance on a per lag basis by minimizing the cost function shown in following equation 6.

(Equation 6)

$$E^L = \sum_t \sum_i \{r_i^t - (e_i^t + g^t \cdot C_i^{L^t})\} \quad [6]$$

where i: sample number $t$: frame number $r_i^t$: ideal excitation

Even with conversion processing of adaptive excitation signals using the above-noted addition, by performing processing based on lag L, it is possible to acquire the same effect as that of the filtering processing shown in Embodiments 1 and 2.

Further, although configuration examples have been explained with Embodiments 1 and 2 where an adaptive excitation is clipped and then subjected to filtering processing, a case is obviously possible where this processing is mathematically equivalent to processing extracting excitations while performing filtering processing. This is obvious from the fact that, when the filter coefficient increases by one in equations 1 and 2, it is possible to express the changed adaptive excitation according to the present embodiment by only equation 2 without equation 1.

Further, although configuration examples have been described with Embodiments 1 and 2 where an MA-type filter is used as a filter, it is obviously possible to use an IIR filter and other non-linear filters and, even then, acquire the same operation effect as that of an MA type filter. The reason is that, even with a non-MA type filter, a adaptive excitation including the filter coefficient of the filter and an ideal excitation can be expressed, and the solution is obvious.

Further, although configuration examples have been explained with Embodiments 1 and 2 where CELP is used as a basic coding scheme, it is obviously possible to adopt other coding schemes if the coding schemes adopt excitation codebooks. The reason is that the filtering processing according to the present invention is performed after an excitation codebook code vector is extracted, and does not depend on whether the spectrum envelope analysis method of is LPC, FFT or filter bank.

Further, configuration examples have been explained with Embodiments 1 and 2 where a range for filtering processing is symmetrical using a lag as a reference position between the past and the future, that is, using the clipped position of the lag as a reference position, it is obviously possible to apply the present invention to an asymmetric range. The reason is that the range of filtering processing has no influence upon coefficient extraction and filtering effects.

Further, although a configuration example has been explained with Embodiment 2 where a lag acquired from the outside is used as is, it is obviously possible to realize low bit rate coding utilizing a lag acquired from the outside. For example, by encoding the difference between a lag acquired from the outside and a lag acquired from the inside of a speech coding apparatus different from the speech coding apparatus according to Embodiment 2, by a fewer number of bits (which is generally referred to as "delta lag coding"), it is possible to acquire a synthesis signal of higher quality.

Further, as obvious from Embodiment 2, the present invention is applicable to a configuration where down sampling of an input signal of the coding target is performed at first, a lag is found from the low sampling signal and a code vector is acquired in an original high sampling area using the lag, that is, a configuration where a sampling rate changes during coding processing. By this means, processing is performed using a low sampling signal, so that it is possible to reduce the amount of calculations. Further, this is obvious from a configuration where a lag is acquired from the outside.

Further, as in the configuration where the sampling rate changes during coding processing, the present invention is applicable to subband-type coding. For example, a lag found in a lower band can be used in a higher band. This is obvious from the configuration where a lag is acquired from the outside.

Further, although cases are illustrated in FIGS. 1 and 5 used in Embodiments 1 and 2 where the output terminal from comparison section 117 is one control signal and the same signal is transmitted to each control target, the present invention is not limited to this, and it is equally possible to output a different appropriate control signal per control target.

The speech coding apparatus according to the present invention can be mounted on a communication terminal apparatus and base station apparatus in the mobile communication system, so that it is possible to provide a communication terminal apparatus, base station apparatus and mobile communication system having the same operational effect as above.

Although a case has been described with the above embodiments as an example where the present invention is implemented with hardware, the present invention can be implemented with software. For example, by describing the speech coding method according to the present invention in a programming language, storing this program in a memory and making the information processing section execute this program, it is possible to implement the same function as the speech coding apparatus of the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2006-216148, filed on Aug. 8, 2006, including the specification, drawings and abstract, is incorporated herein by reference in its entirety.

INDUSTRIAL APPLICABILITY

The speech coding apparatus and speech coding method according to the present invention are applicable to, for example, a communication terminal apparatus and base station apparatus in the mobile communication system.

The invention claimed is:

1. A speech coding apparatus comprising:

an excitation searcher that performs an adaptive excitation search and fixed excitation search;

an adaptive codebook that stores an adaptive excitation and clips a part of the adaptive excitation;

a filter that performs predetermined filtering processing on the adaptive excitation clipped from the adaptive codebook;

a fixed codebook that stores a plurality of fixed excitations and extracts a fixed excitation indicated by the excitation searcher; and a switch that switches between the adaptive excitation clipped by the adaptive codebook and the adaptive excitation after the filter processing by the filter, wherein the excitation searcher performs a search using the adaptive excitation clipped from the adaptive codebook, by controlling the switch to output the adaptive excitation clipped by the adaptive codebook during the adaptive excitation search, and performs a search using the adaptive excitation after the predetermined filtering processing, by controlling the switch to output the adaptive excitation after the filter processing by the filter during the fixed excitation search.

2. The speech coding apparatus according to claim 1, wherein the adaptive codebook clips the part of the adaptive excitation according to an indication from the excitation searcher.

3. The speech coding apparatus according to claim 1, wherein the adaptive codebook clips the part of the adaptive excitation according to an indication from an outside.

4. The speech coding apparatus according to claim 1, wherein the excitation searcher performs a gain adjustment for the adaptive excitation after the filtering processing and the fixed excitation extracted from the fixed codebook, adds the adaptive excitation and the fixed excitation for which the gain adjustment is performed, and performs the fixed excitation search using the addition result.

5. A speech coding method, performed by a processor, comprising:

performing, by the processor, an adaptive excitation search of an adaptive excitation stored in an adaptive codebook;

clipping, by the processor, a part of the adaptive excitation from the adaptive codebook using a result of the adaptive excitation search;

performing, by the processor, predetermined filtering processing on the adaptive excitation clipped from the adaptive codebook;

selecting one of the clipped adaptive excitation search and the adaptive excitation search after the predetermined filtering processing; and performing, by the processor, a fixed excitation search of a plurality of fixed excitations stored in a fixed codebook using the adaptive excitation after the predetermined filtering processing, which is selected during the fixed excitation search, wherein the selecting selects the clipped adaptive excitation search during the adaptive excitation search.

6. The speech coding apparatus according to claim 1, further comprising an LPC synthesizer that acquires a synthesis signal by performing filtering processing on the adaptive excitation clipped from the adaptive codebook, using an LPC coefficient obtained by performing an LPC analysis on an input signal, wherein the predetermined filtering processing performed by the filter is different from the filtering processing performed by the LPC synthesizer.

7. The speech coding apparatus according to claim 1, wherein the filter performs MA (Moving Average) type multi-tap filtering processing.

8. The speech coding method according to claim 5, further comprising acquiring a synthesis signal by performing filtering processing on the adaptive excitation clipped from the adaptive codebook, using an LPC coefficient obtained by performing an LPC analysis on an input signal, wherein the predetermined filtering processing is different from the filtering processing using the LPC coefficient obtained by performing the LPC analysis on the input signal.

9. The speech coding method according to claim 5, wherein the predetermined filtering processing performs MA (Moving Average) type multi-tap filtering processing.

* * * * *